US007484342B2

(12) United States Patent
Frazier

(10) Patent No.: US 7,484,342 B2
(45) Date of Patent: Feb. 3, 2009

(54) APPARATUS AND METHOD FOR AUTOMATED TAPE CLOSURE

(75) Inventor: Jimmy R. Frazier, Norman, OK (US)

(73) Assignee: Burford Corporation, Maysville, OK (US)

( * ) Notice: Subject to any disclaimer, the term of this patent is extended or adjusted under 35 U.S.C. 154(b) by 0 days.

(21) Appl. No.: 11/595,677

(22) Filed: Nov. 10, 2006

(65) Prior Publication Data

US 2007/0107378 A1 May 17, 2007

Related U.S. Application Data

(60) Provisional application No. 60/597,139, filed on Nov. 11, 2005.

(51) Int. Cl.
*B65B 51/06* (2006.01)
*B65B 57/10* (2006.01)

(52) U.S. Cl. ..... 53/138.7; 53/137.2; 53/419; 53/500

(58) Field of Classification Search ..... 53/58, 53/500, 502, 136.5, 137.2, 138.7, 139.1, 53/419, 416

See application file for complete search history.

(56) References Cited

U.S. PATENT DOCUMENTS 1,196,460 A * 8/1916 Jessen ..... 53/138.7
2,916,863 A 12/1959 Leighton et al.
3,141,277 A * 7/1964 Johnston ..... 53/583
3,173,232 A * 3/1965 Mercer ..... 53/136.5
3,375,634 A * 4/1968 Jarund ..... 53/415
4,242,171 A 12/1980 Kauer et al.
4,534,149 A * 8/1985 Hoyland ..... 53/76
4,537,005 A 8/1985 Hoyland
4,554,776 A * 11/1985 Chikatani ..... 53/76
4,621,479 A * 11/1986 Hoyland ..... 53/133.3
4,660,351 A 4/1987 Saitoh
4,813,207 A 3/1989 Rundle
4,856,258 A 8/1989 Burford et al.
4,912,913 A * 4/1990 Rundle ..... 53/583
5,173,140 A * 12/1992 Vasilakes ..... 156/212
5,279,094 A * 1/1994 Odom et al. ..... 53/139.1
5,896,726 A 4/1999 Kellaway
6,033,762 A 3/2000 Decker
6,886,310 B1 5/2005 Bois

FOREIGN PATENT DOCUMENTS

WO WO 9406687 A1 * 3/1994

* cited by examiner

*Primary Examiner*—Paul R Durand
(74) *Attorney, Agent, or Firm*—Crowe & Dunlevy, P.C.

(57) ABSTRACT

Disclosed is a tape closure device for securing the neck of a bag with an adhesive film and a non-adhesive backing. The device preferably includes a closure application assembly that has a guide rail, a contact member and a cutting member. The guide rail preferably includes a contact section, a gathering section and a staging section. The contact member preferably includes a contact surface adjacent the contact section of the guide rail. The tape closure device also preferably includes a tape feed assembly, a paper feed assembly and a bag feed assembly.

10 Claims, 14 Drawing Sheets

APPARATUS AND METHOD FOR AUTOMATED TAPE CLOSURE

RELATED APPLICATIONS

This application claims the benefit of U.S. Provisional Patent Application Ser. No. 60/597,139 filed Nov. 11, 2005, entitled "Apparatus and Method for Automated Tape Closure," the disclosure of which is hereby incorporated.

FIELD OF THE INVENTION

The present invention is generally related to the field of automated bag closure systems.

BACKGROUND OF THE INVENTION

For many years, manufacturers have used plastic bags to package a wide variety of products. In some industries, it is desirable to provide a plastic bag that can be repetitively opened and sealed by the consumer. For example, bread is often enclosed in a plastic bag that is bound with a twist-tie. The twist-tie closure allows the consumer to open and close the bag multiple times, thereby extending the use of the bag for the life of the product.

Although twist-ties are favored for their inexpensive cost, competing closure mechanisms have also been employed. For example, plastic lock-tabs are frequently used to close plastic bags containing perishable bakery items. Lock-tabs are easy to apply and offer the packager a surface upon which information can be printed. While generally acceptable, lock-tabs are relatively expensive. As an alternative, manufacturers have employed tape closure systems in which the neck of the bag is captured by a piece of one-sided tape. Tape closure systems offer the cost benefits of twist-ties and the ability to print information on the closure provided by lock-tabs.

Prior art tape closure systems function by applying a preset amount of tape to the neck of the bag. In these systems, changes in the diameter of the bag neck tend to create variations in the "legs" of the tape that extend from the neck. Variations in the lengths of the tape legs increase the difficulty of printing information on the tape and may present problems during use by the consumer. Accordingly, there is a need for an improved tape closure system that overcomes these deficiencies of the prior art.

SUMMARY OF THE INVENTION

In preferred embodiments, the present invention includes a tape closure device for securing the neck of a bag with an adhesive film and a non-adhesive backing. In the preferred embodiment, the device includes a closure application assembly that has a guide rail, a contact member and a cutting member. The guide rail preferably includes a contact section, a gathering section and a staging section. The contact member preferably includes a contact surface adjacent the contact section of the guide rail. The tape closure device also preferably includes a tape feed assembly, a paper feed assembly and a bag feed assembly. Each of these components cooperates in the preferred embodiment to produce a continuous, linear-motion tape closure operation.

DETAILED DESCRIPTION OF PREFERRED EMBODIMENTS

In accordance with a preferred embodiment, the present invention includes a tape closure system for use in conjunction with an automated packaging system. Although the preferred embodiment is disclosed for use in a bakery environment, it will be understood that the tape closure device could find utility in a wide variety of other applications.

Figure 1:
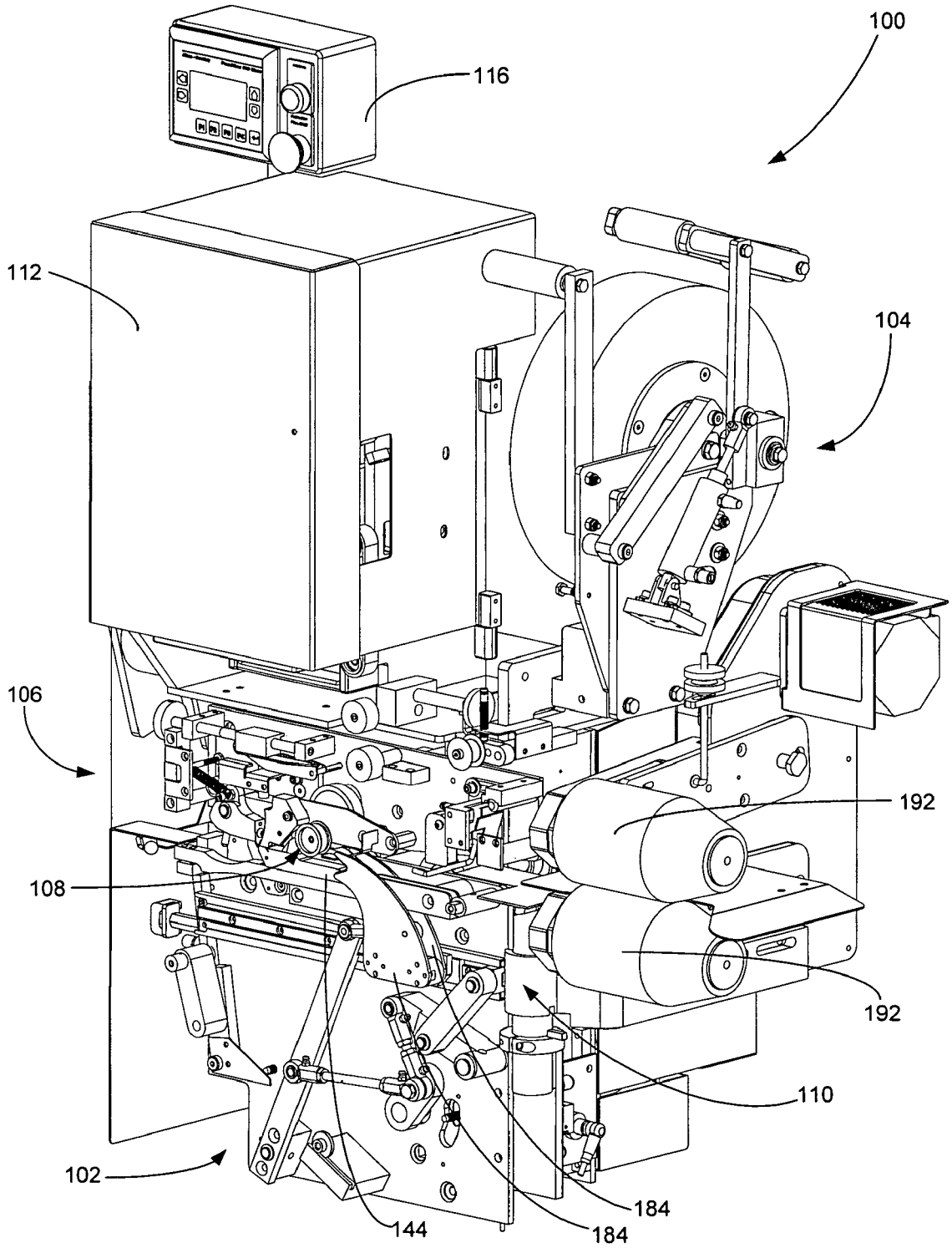
FIG. 1 is a front perspective view of a tape closure device constructed in accordance with a presently preferred embodiment.

Referring to FIG. 1, shown therein is a perspective drawing of a preferred embodiment of a tape closure device 100. The tape closure device 100 preferably includes a plunger assembly 102, a tape feed assembly 104, a paper feed assembly 106 (not fully visible in FIG. 1), a closure application assembly 108 and a bag feed assembly 110. The tape closure device 100 also preferably includes a printer assembly 112 configured to print desired information (i.e., date, location, batch) on the tape delivered from the tape feed assembly 104 and controls 116 to adjust the automated function of the tape closure device 100.

Figure 2:
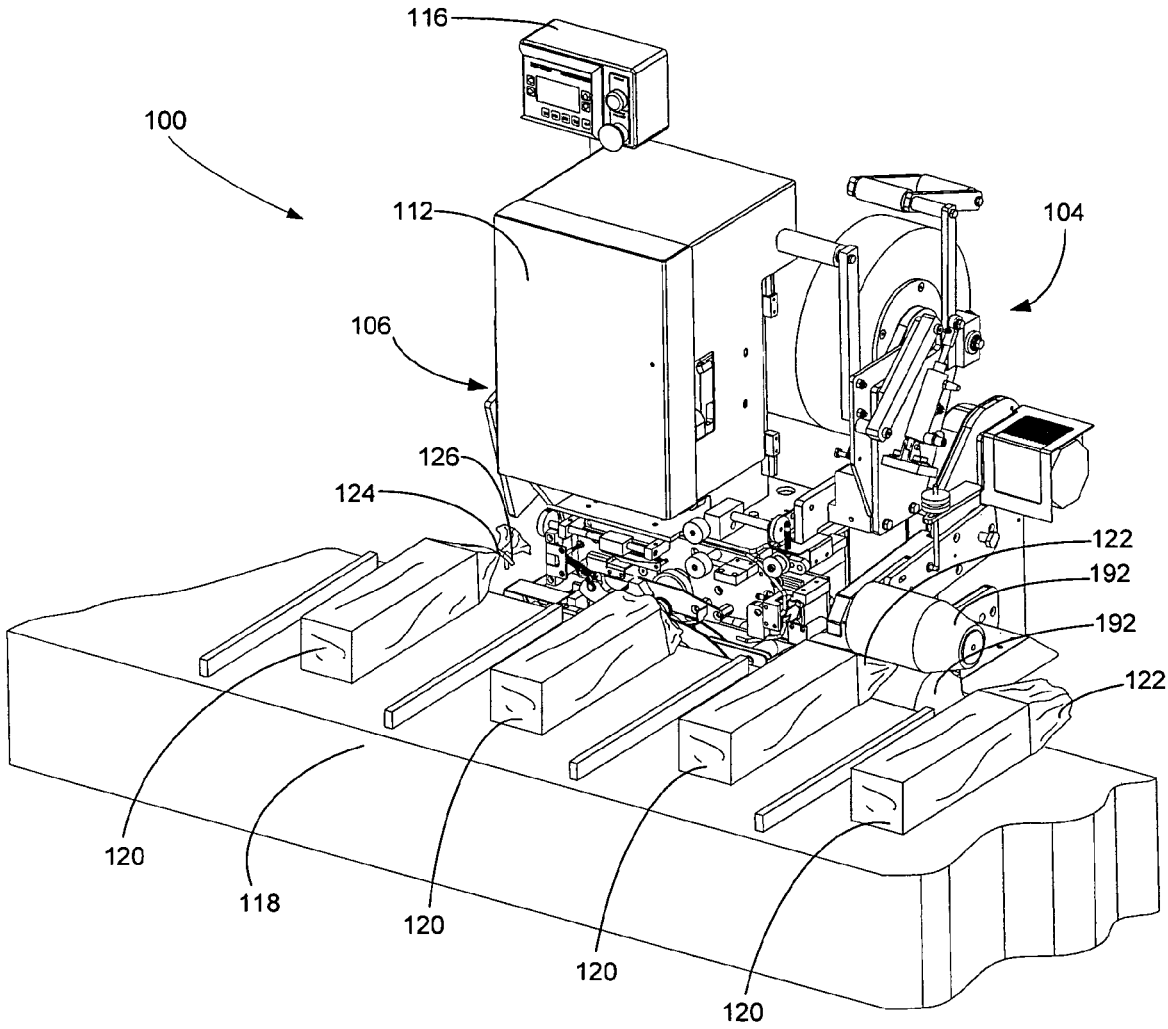
FIG. 2 is a front perspective view of the tape closure device of FIG. 1 in operation with a conveyor system.

The operation of the tape closure device 100 is generally depicted in FIG. 2. FIG. 2 provides a front perspective view of the tape closure device 100. As shown in FIG. 2, the tape closure device 100 placed in adjacency with a conveyor system 118. The tape closure device 100 is well adapted to be used in concert with a conveyor-type, assembly line packaging operation. In FIG. 2, the conveyor system 118 is carrying filled bags 120 from right to left through the tape closure device 100. It will be understood that through use of the controls 116, the operation of the tape closure device 100 is automated and based on user settings and closed-loop feedback.

Figure 20:
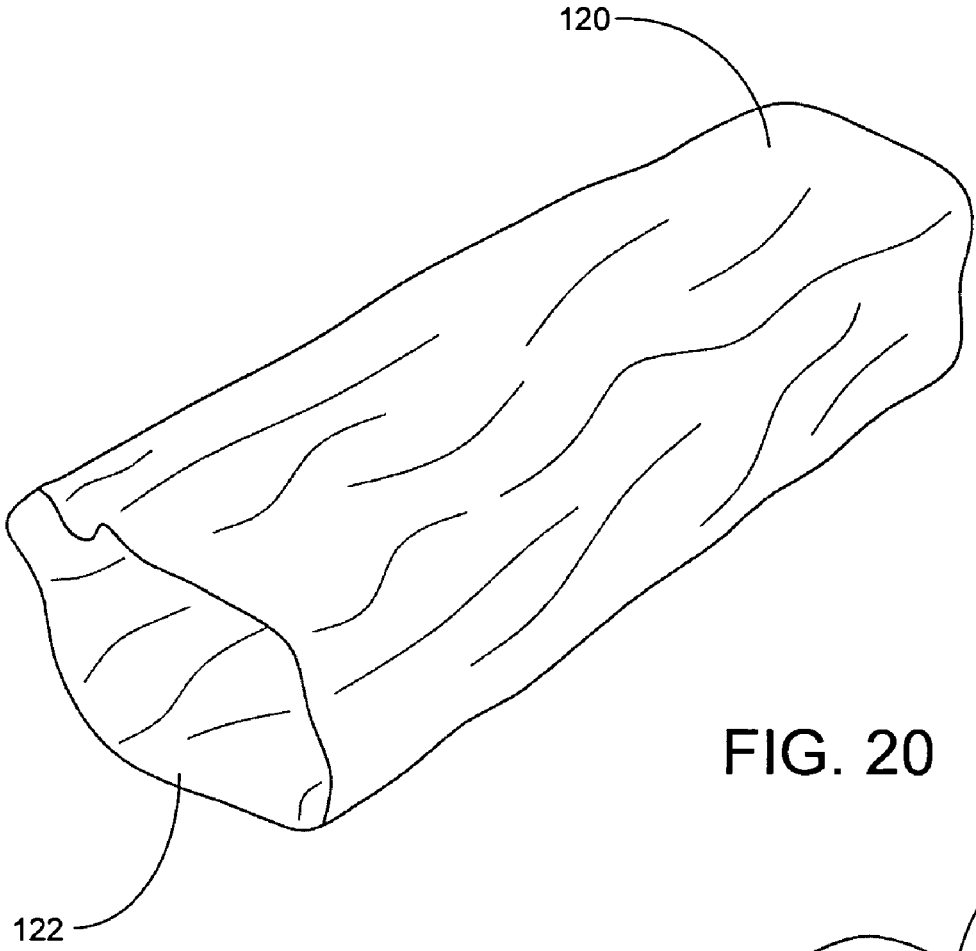
FIG. 20 is a perspective view of a filled bread bag with an open end.
Figure 21:
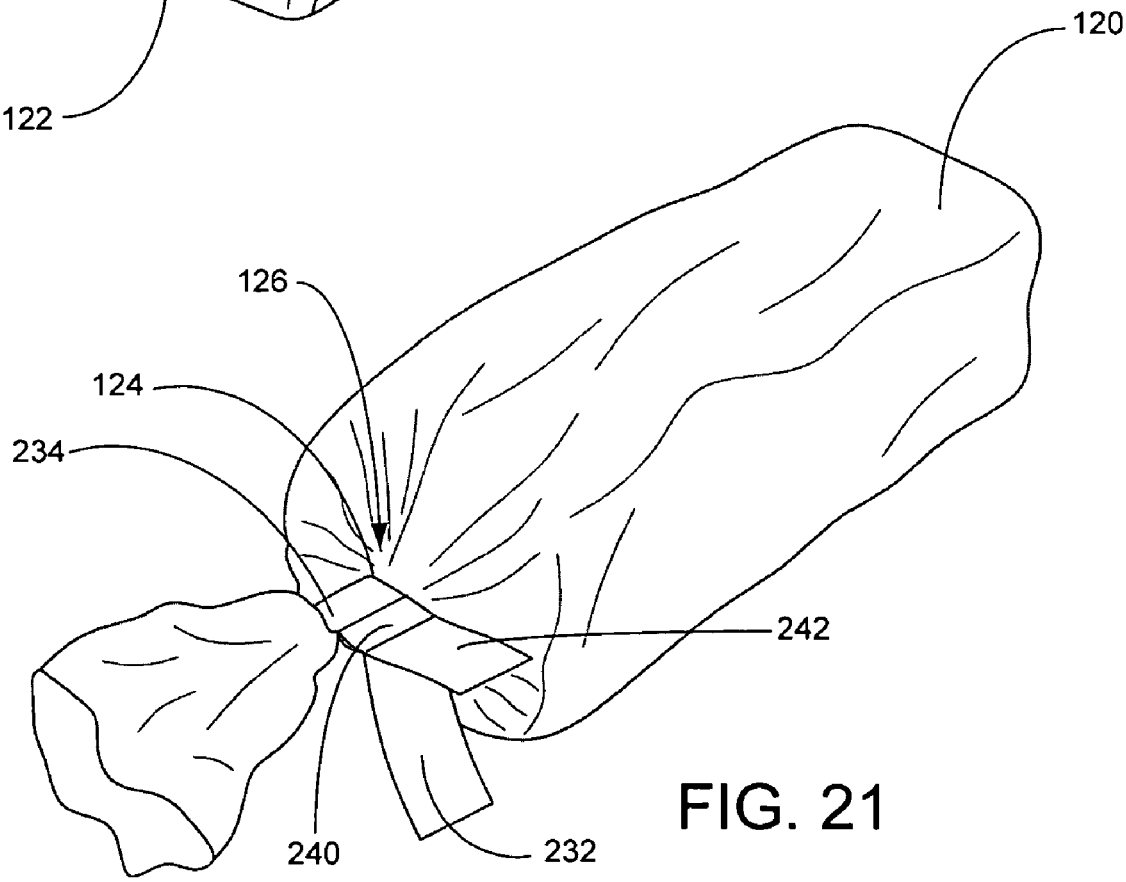
FIG. 21 is a perspective view of the bread bag of FIG. 20 with the open end closed and secured with a tape closure applied through preferred embodiments.

Starting on the upstream side of the conveyor system 118, unclosed bags 120 are fed through the tape closure device 100 with the open end 122 of the bag 120 passing through the closure application assembly 108. As the bags 120 pass through the tape closure device 100, the tape closure device 100 gathers the open ends 122 of each bag 120 into a neck 124 and applies a closure 126 around the neck 124 to keep the bag 120 closed. The closure 126 is preferably formed with one-sided releasable adhesive tape that is partially secured to a non-adhesive backing paper to facilitate release of the closure 126. The closure 126 is configured to be repetitively removed and re-attached to the neck 124 of the bag 120. FIGS. 20 and 21 provide perspective views of a bag 120 with an open end 122 and a bag 120 with a closure 126 around the neck 124.

Figure 3:
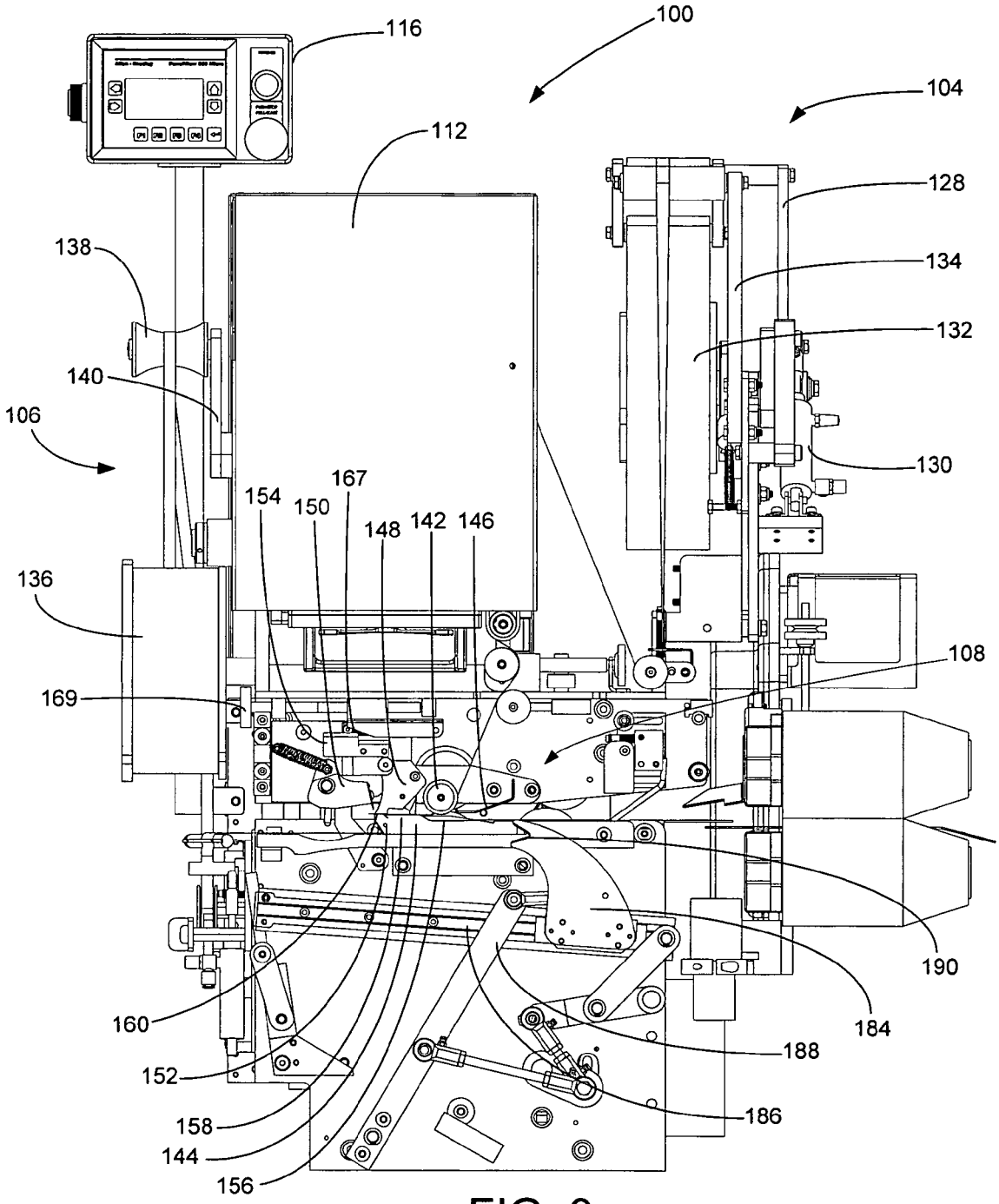
FIG. 3 is a front view of a portion of the tape closure device of FIG. 1.
Figure 6:
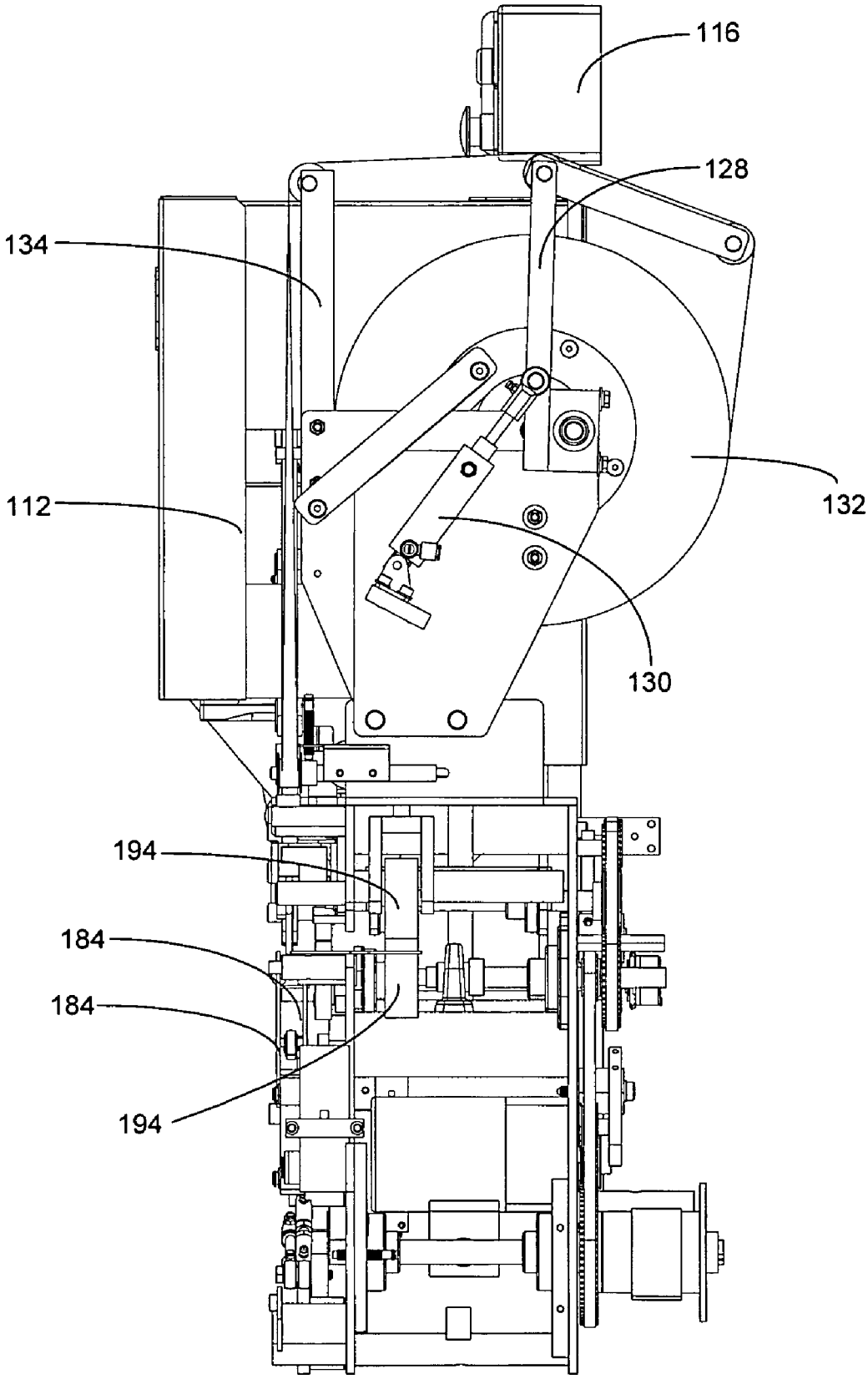
FIG. 6 is a right side view of the tape closure device of FIG. 1.

Turning to FIG. 3, shown therein is a front view of the tape closure device 100. The tape feed assembly 104 generally includes a take-up mechanism 128, a pneumatic or hydraulic cylinder 130, a roll of tape 132 and a disengagement arm 134. Portions of the tape feed assembly 104 are also shown in FIG. 6. For the tape closure device 100 to work properly, it is desirable that the tape feed assembly 104 provide a limited amount of resistance to tape being paid out from the roll 132 as the bag is pushed through the closure application assembly 108. Before the next cycle begins, the cylinder 130 extends the take-up mechanism 128, thereby peeling a quantity of tape off the roll of tape 132. In this way, during the subsequent cycle of operation, the movement of the tape through the closure application assembly 108 is unhindered by resistance from the roll of tape 132. To change the roll of tape 132, the disengagement arm 134 is pulled forward. The roll of tape 132 travels forward with the disengagement arm 134 to provide access to the roll of tape 132 from the front of the tape closure device 100.

Similarly, the paper feed assembly 106 preferably includes a spool 136, a drag pulley 138 a pay-out linkage 140 and a pneumatic or hydraulic cylinder (not shown). Between closure cycles, the cylinder retracts and the pay-out linkage 140 pulls a selected amount of backing paper from the spool 136 and drag pulley 138. The cylinder then extends to provide a desired amount of slack in the backing paper.

The closure application assembly 108 preferably includes a tape guide pulley 142, a guide rail 144, a contact member 148, a cutting member 150, a paper feed pulley 152, and a blade guard 154. The guide rail 144 preferably includes a staging section 156, a gathering section 158 and a contact section 160. Paper is fed from the left side of the closure application assembly 108 around the paper feed pulley 152 and through a slot 38 in the contact section 160. Tape is fed from the right side of the closure application assembly 108 around the tape guide pulley 142 towards the contact section 160. The tape is preferably fed such that the adhesive side of the tape is oriented towards the guide rail 144.

In the preferred embodiment, the gathering section 158 of the guide rail 144 is slightly lower than the contact section 160. In a particularly preferred embodiment, the gathering section 158 is approximately 0.5 mm lower than the contact section 160. There is an additional, more substantial step down to the staging section 156. The profile of the guide rail 144 is well illustrated in FIG. 9. The relative positions and geometries of the tape guide pulley 142 and the guide rail 144 are preferably configured such that the tape only comes in contact with the gathering section 158 and contact section 160 of the guide rail 144 during use. The tape passes above the staging section 156. At the beginning of each cycle, tape is secured to the contact section 160 under the contact member 148, with the leading portion of the tape secured to the backing paper.

Figure 4:
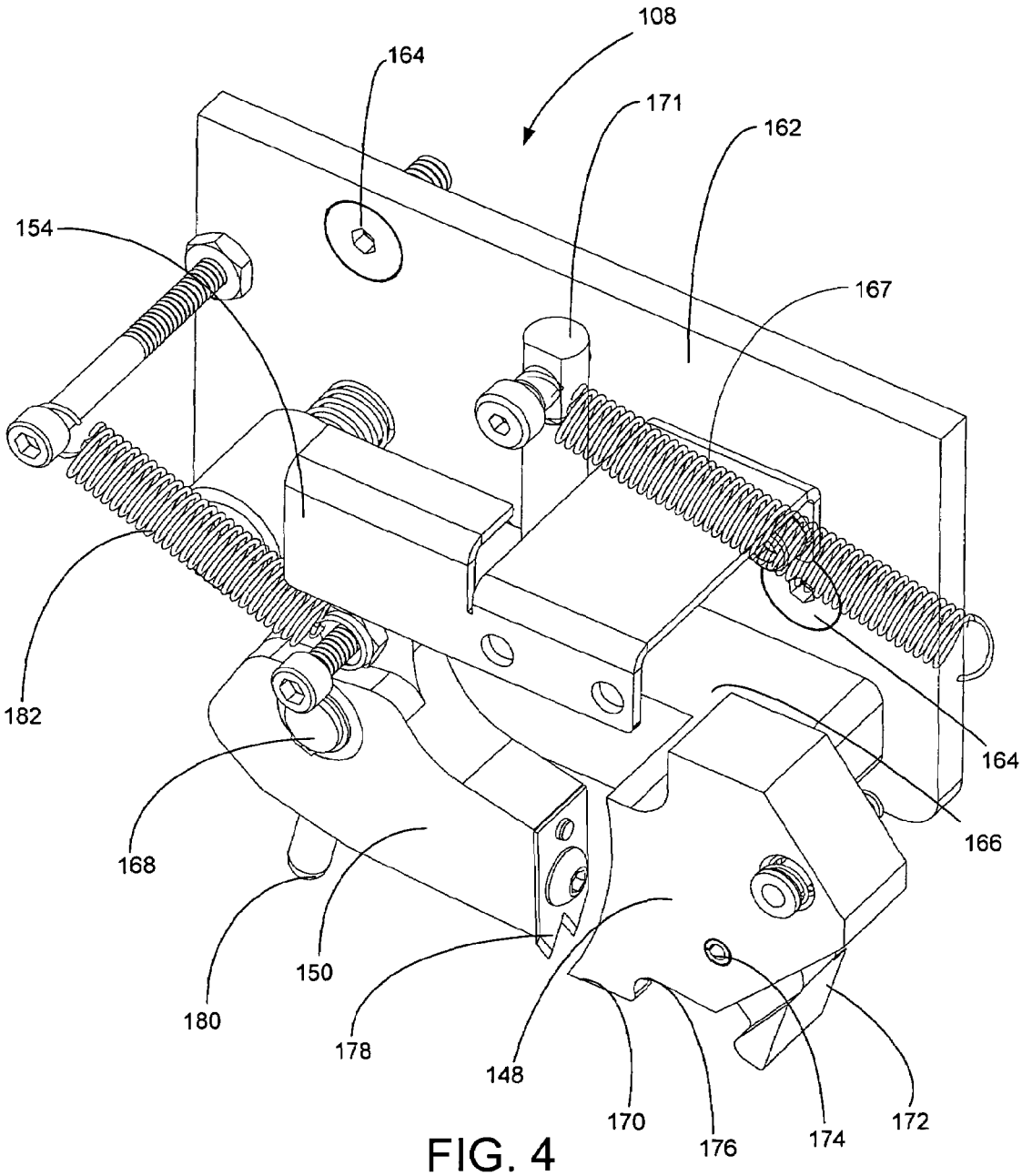
FIG. 4 is a close-up perspective view of a portion of the closure application assembly.

Referring now also to FIG. 4, shown therein is a front perspective view of a portion of the closure application assembly 108. In a preferred embodiment, the cutting member 150 and contact member 148 are connected to a support plate 162 that can be easily attached to, and removed from, the tape closure device 100 through the respective engagement and disengagement of fasteners 164. In this way, the cutting member 150 and contact member 148 can be quickly exchanged for repair or to make use of cutting members 150 and contact members 148 with different geometries or configurations.

The contact member 148 is connected to a pivot arm 166 that is journaled about pivot 168. The distance and relative position of the contact member 148 and the pivot 168 cause contact member 148 to translate in a substantially vertical direction. A first end of a spring 167 is attached to post 171 and when placed in tension applies a moment through pivot arm 166 about pivot 168 to create a downward force on the contact member 148. The second end of spring 167 is attached to a pin (not shown in FIG. 4) that is part of an adjustment mechanism 169. The adjustment mechanism 169 that can be manipulated to adjust the amount of tension in the spring 167 which in turn changes the amount of force exerted by the contact member 148 on the contact section 160. When used on bags 120 constructed of delicate materials, the amount of force exerted by the contact member 148 should be reduced to prevent the closure application assembly 108 from ripping the bags 120.

The contact member 148 preferably includes a bag stop 172. The bag stop 172 is preferably configured as a "finger" that extends downward toward the gathering section 158 of the guide rail 144. The width of the bag stop 172 is preferably configured to be approximately the same as the width of the tape. The bag stop 172 is configured to rotate about axle 174 to a retracted position inside recess 176 in contact member 148. The bag stop 172 is preferably spring-biased against retraction into the contact member 148.

The cutting member 150 preferably includes a blade 178 and a lever arm 180. The cutting member 150 is configured to independently rotate about pivot 168. A spring 182 biases the cutting member 150 in a retracted position. When the neck 124 of the bag 120 contacts the lever arm 180, the cutting member 150 rotates in a clockwise direction. The clockwise rotation of the cutting member 150 causes the blade 178 to sever the trailing tape and paper from the closed bag neck 124. When the closed-neck 124 clears the lever arm 180, the cutting member 150 returns to its default position and the plunger 184 returns to its home position in preparation for a subsequent cycle of operation.

When tape and paper are loaded into the closure application assembly 108, the cutting member 150 must be manually retracted by rotating the cutting member in a counterclockwise direction. When lifted in this way, the blade 178 is exposed and presents a risk of harm to the operator. The blade guard 154 conceals the blade 178 while the cutting member 150 is in the retracted position. After the paper and tape have been loaded into the closure application assembly 108, the cutting member 150 is deployed to its operative position by rotating the cutting member 150 in a clockwise direction.

Turning back to FIG. 3, the plunger assembly 102 preferably includes a pair of plungers 184, a track 186 and a series of linkages 188. Each plunger 184 preferably includes a notched portion 190 configured to securely grasp the neck 124 of the bag 120 on either side of the guide rail 144. As better shown in the perspective view in FIG. 1, the plungers 184 are spaced on either side of the guide rail 144. The plunger assembly 102 moves the plungers 184 in a single rotation for each cycle of the tape closure device 100.

Figure 5:
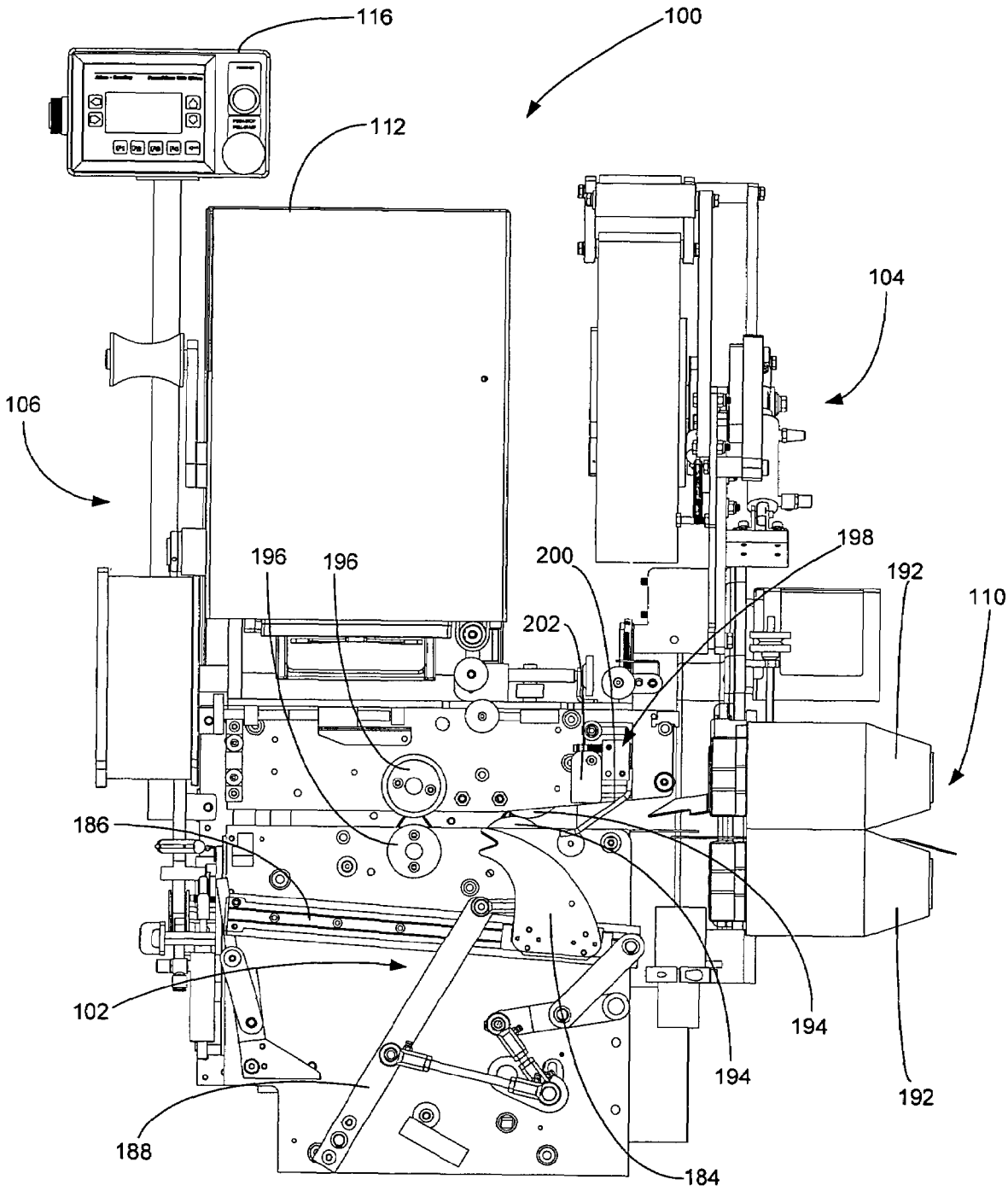
FIG. 5 is a front view of the tape closure device of FIG. 1 with a portion of the closure application assembly removed to better depict portions of the bag feed assembly.

Turning to FIG. 5, shown therein is a front view of the tape closure device 100 with portions of the closure application assembly 108 removed. In a first preferred embodiment, the bag feed assembly 110 preferably includes a pair of brushes 192, auxiliary brushes 194, drive rollers 196 and a sensor 198. The brushes 192 are preferably configured to spin in opposite directions to pull the open end 122 of a bag 120 through the brushes 192. In this way, the brushes 192 flatten the open end 122 as the bag 120 passes through the brushes 192. The speed at which the brushes 192 spin is independent of the speed of the conveyor system 118. Although the brushes 192 are movable, the brushes 192 preferably spin on horizontal axes that are substantially parallel to the path of the bag 120 through the tape closure device 100.

Auxiliary brushes 194 are configured to encourage the movement of the open end 122 through the tape closure device 100 as the body of the bag 120 moves along the conveyor system 118. In a particularly preferred embodiment, only the lower auxiliary brush 194 is powered and the upper auxiliary brush 194 turns in response to contact with the upper auxiliary brush 194. In a preferred embodiment, the speed at which the auxiliary brushes 194 turn is proportional to the speed of the drive rollers 196. The internal location of the auxiliary brushes 194 is best seen in FIG. 6. The auxiliary brushes 194 preferably spin on horizontal axes that are substantially transverse to the path of the bag 120 through the tape closure device 100.

The drive rollers 196 are configured to rotate in opposite directions at a speed proportional to the speed of the conveyor system 118. In the preferred embodiment, the upper drive roller 196 is configured to translate vertically during operation, while the lower drive roller 196 is fixed. The articulation of the upper drive roller 196 allows the closure application assembly 108 to accommodate bags 120 of different sizes without incurring damage to the tape closure device 100.

The sensor 198 preferably includes a trigger 200 and a counterweight 202. As the open end 122 of the bag 120 enters the tape closure device 100, the bag lifts the trigger 200 which causes the sensor 198 to send a signal to the programmable logic control (PLC) to start a bag closure cycle. In a particularly preferred embodiment, the sensor 198 is configured to identify the trailing edge of the flattened bag 120 as it enters the tape closure device 100. The action on the trigger 200 is preferably light such that the sensor 198 is capable of detecting the presence of thin bags 120. To keep the trigger 200 from overextending, counterweight 202 is positioned to deflect the movement of the trigger 200 beyond a preset point.

In operation, the brushes 192 flatten the open end 122 as the bag 120 moves downstream with the conveyor system 118. The flattened open end 122 of the bag 120 trips the sensor 198 to initiate a closure cycle. As the closure cycle begins, the bag 120 continues its downstream movement through the tape closure device 100 and the open end 122 is passed through the auxiliary brushes 194 to the drive rollers 196. The drive rollers 196 push the open end 122 into the gathering section 158 of the guide rail 144 where the bag neck 124 is formed.

Figure 7:
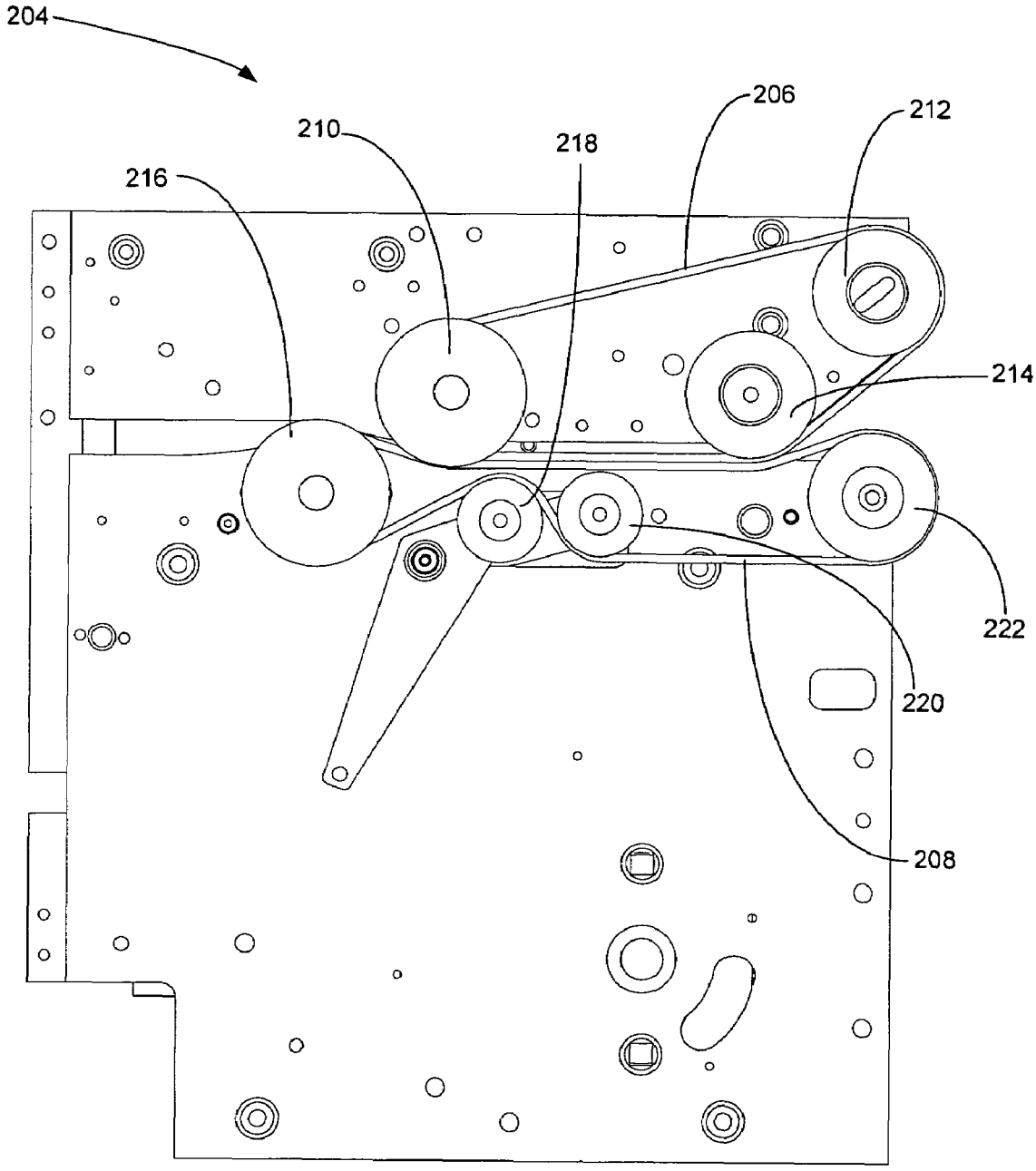
FIG. 7 is a front view of the tape closure device of FIG. 1 with an alternate preferred embodiment of the bag feed assembly.

Turning now to FIG. 7, shown therein is an alternate preferred embodiment of the bag feed assembly 110 which makes use of a belt drive system 204 as an alternative to the drive rollers 196 and auxiliary brushes 194. The belt drive system 204 includes upper and lower gathering belts 206, 208. The purpose of belt drive system 204 is to transport the open end 122 of the bag 120 between two belts. A common problem with traditional mechanisms of this type is rapid belt wear caused by the surface speeds of the two belts not being precisely the same speed in the contact areas of the belts.

The upper and lower gathering belts 206, 208 rotate in opposite directions and transport the bag from right to left through the tape closure device 100. Upper gathering belt 206 travels clockwise around the three upper belt pulleys 210, 212 and 214. Lower gathering belt travels counter-clockwise around lower belt pulleys 216, 218, 220 and 222. The path of upper gathering belt 206 is not affected by the presence of the lower gathering belt 208 or any of the lower belt pulleys 216, 218, 220 or 222. Changing the tension of upper gathering belt 206 has no significant effect on the ability of the belt drive system 204 to pull the bag 120 forward.

The lower belt pulleys 216, 218, 220 and 222 are placed such that the lower gathering belt 208 actually wraps around the upper gathering belt 206, which is itself wrapped around lower belt pulleys 216, 218, 220 and 222. Lower belt pulleys 216 and 220 are used to tension the lower gathering belt 208. The angle of belt wrap around lower belt pulleys 210 and 212 is small (approximately 10 degrees). However, it is this wrap angle that gives the belt drive system 204 its entire authority to pull the bag 120 forward into the closure application assembly 108. As tension is increased in the lower gathering belt 208, the lower gathering belt 208 presses harder against the upper gathering belt 206, but only in the two contact regions where the lower gathering belt 208 is wrapped around the upper gathering belt 206 on upper belt pulleys 210 and 214. Between the contact regions, the upper and lower gathering belts 206, 208 are relatively parallel and there is no contact pressure between them, so this section of the belts is not effective in pulling the bag 120 forward.

As a belt passes around a pulley, the belt becomes curved to match the shape of the pulley. When the belt is curved, that portion of the belt nearer the center of the pulley becomes compressed and moves relatively slowly, while the surface of the belt farthest from the pulley center gets stretched and moves at a slightly higher speed. Between the inner and outer surfaces of the belt, there is an internal surface that is being neither compressed nor stretched. This "neutral" surface travels at a speed that is intermediate between the speed of the inner and outer surfaces.

If the lower gathering belt 208 has a small amount of wrap around the upper gathering belt 206 on upper belt pulley 214, it is desirable to have the speed of the lower surface of upper gathering belt 206 be precisely the same as the speed of the upper surface of lower gathering belt 208, so that the tendency of the two belts to scuff against each other is eliminated. To satisfy this requirement, it is necessary for the lower surface of the lower gathering belt 208 be traveling at an even higher speed, as befits its larger radius from the center of upper belt pulley 214. Therefore, the neutral surface of the lower gathering belt 208 must be traveling at a greater speed than the neutral surface of the upper gathering belt 206.

Between upper belt pulleys 210 and 214, the lower gathering belt 208 is substantially straight, so the upper and lower surfaces of the two belts travel at the same speed. The same applies to the upper gathering belt 206. In this area, the linear speed of the lower gathering belt 208 will be significantly greater than that of the upper gathering belt 206. This does not contribute to a belt wear problem because the belts have essentially no contact pressure between them.

In the preferred embodiment, upper belt pulleys 212 and 214 are substantially the same size. That is, upper belt pulleys 212 and 214 preferably have the same pitch diameter. This is necessary so that the belts assume the same curvature around upper belt pulley 212 as they do around upper belt pulley 214. If lower belt pulley 216 and upper belt pulley 210 are driven at the same rotational speed, which is typical, then pulley lower belt pulley 216 must have a pitch diameter that is a few percent greater than upper belt pulleys 210 or 214. The percentage difference depends, among other things, upon the thickness of the belts being used. Although this system might work well for a particular set of belts, the variation in profile between different production belts from the same and different suppliers can cause undesirable belt wear to occur.

A particularly preferred embodiment of the belt drive system 204 allows the upper gathering belt 206 to be driven by its contact with the lower gathering belt 208. This ensures that the contact surfaces of the two belts are traveling at the same speed (assuming sufficient wrap angle and belt tension to drive the upper belt without slipping), regardless of the belt profile.

FIGS. 8-19 illustrate the action of the closure application assembly 108 during use. FIGS. 8, 10, 12, 14, 16 and 18 provide a front view of the tape closure device 100 and more particularly the position of the plunger assembly 102 at various stages along the closure cycle. FIGS. 9, 11, 13, 15, 17 and 19 provide a close-up view of a portion of the closure application assembly 108 to better illustrate the movement of the bag 120 through the closure application assembly 108. The plunger assembly 102 has been removed in FIGS. 9, 11, 13, 15, 17 and 19 to more clearly demonstrate passage of the bag neck 124 through the closure application assembly 108. Although the operation of the closure application assembly 108 has been illustrated in a series of stages for the purposes of this disclosure, it will be understood that the process involves a continuous, linear motion through the closure application assembly 108. In the preferred embodiment, the closure application assembly 108 functions without interrupting the flow of the overall dynamic packaging operation.

Figure 8:
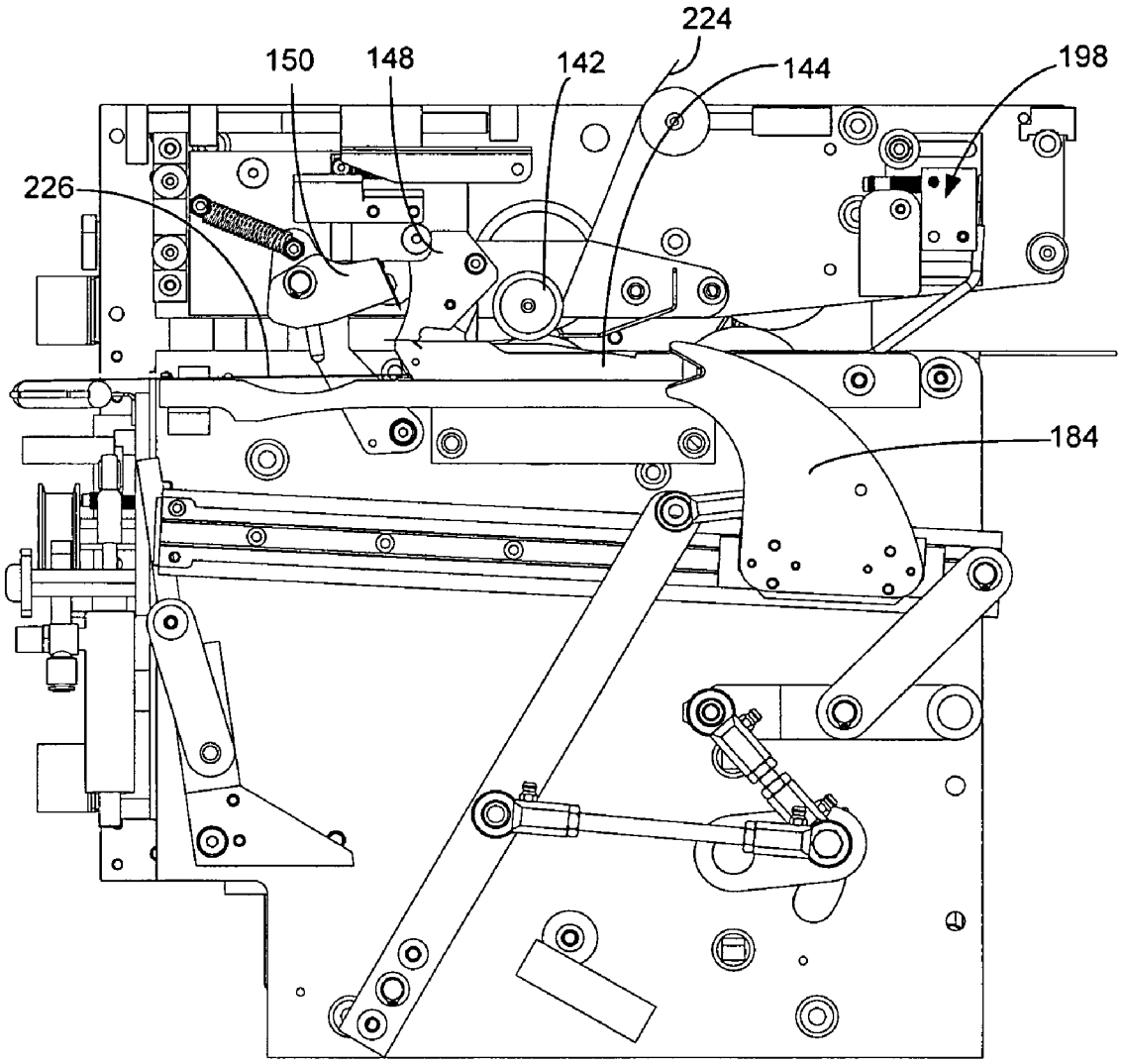
FIG. 8 is a front view of a portion of the tape closure device in a first stage of operation.

Turning to FIG. 8, shown therein is a front partial view of the tape closure device 100 in a first stage of operation. Tape 224 is introduced from the tape feed assembly 104 to the closure application assembly 108 around tape guide pulley 142. Backing paper 226 is introduced from the paper feed assembly 106 through the paper feed pulley 152. At the beginning of a closure cycle, the plungers 184 are in a starting position as a bag 120 is introduced into the closure application assembly 108 by the bag feed assembly 110. Once the trailing end of the bag 120 releases the trigger 200, the controls 116 initiate a closure cycle.

Figure 9:
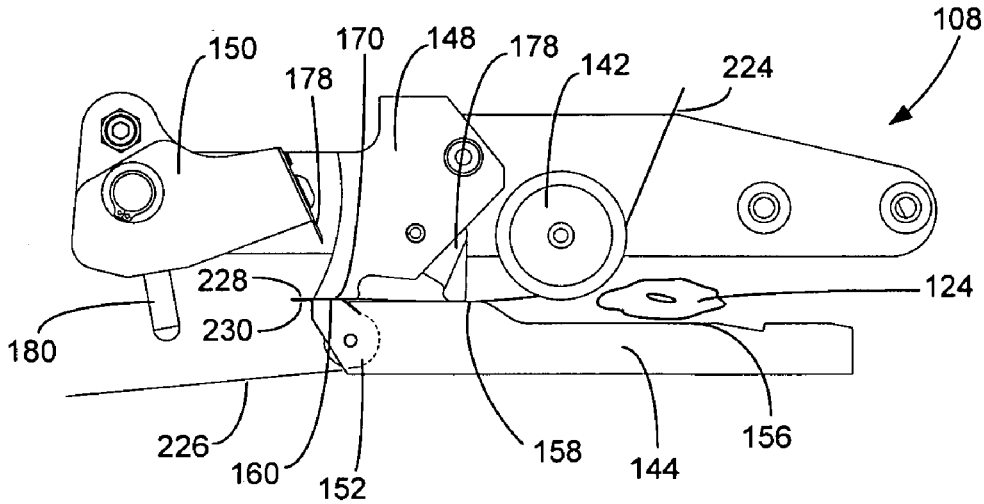
FIG. 9 is a close-up illustration of the closure application assembly at the first stage of operation shown in FIG. 8.

Referring now to FIG. 9, the adhesive side of the tape 224 is in contact with the guide rail 144 along the gathering section 158. The paper 226 is fed around the paper feed pulley 152 through the guide rail 144 and onto the contact section 160. A paper leading portion 228 is secured to the adhesive side of the tape leading portion 230 and compressed between the contact surface 170 and the contact section 160 to form a first tape leg 232. As shown in FIG. 9, the paper leading portion 228 and tape leading portion 230 extend slightly beyond the downstream side of the guide rail 144.

Figure 10:
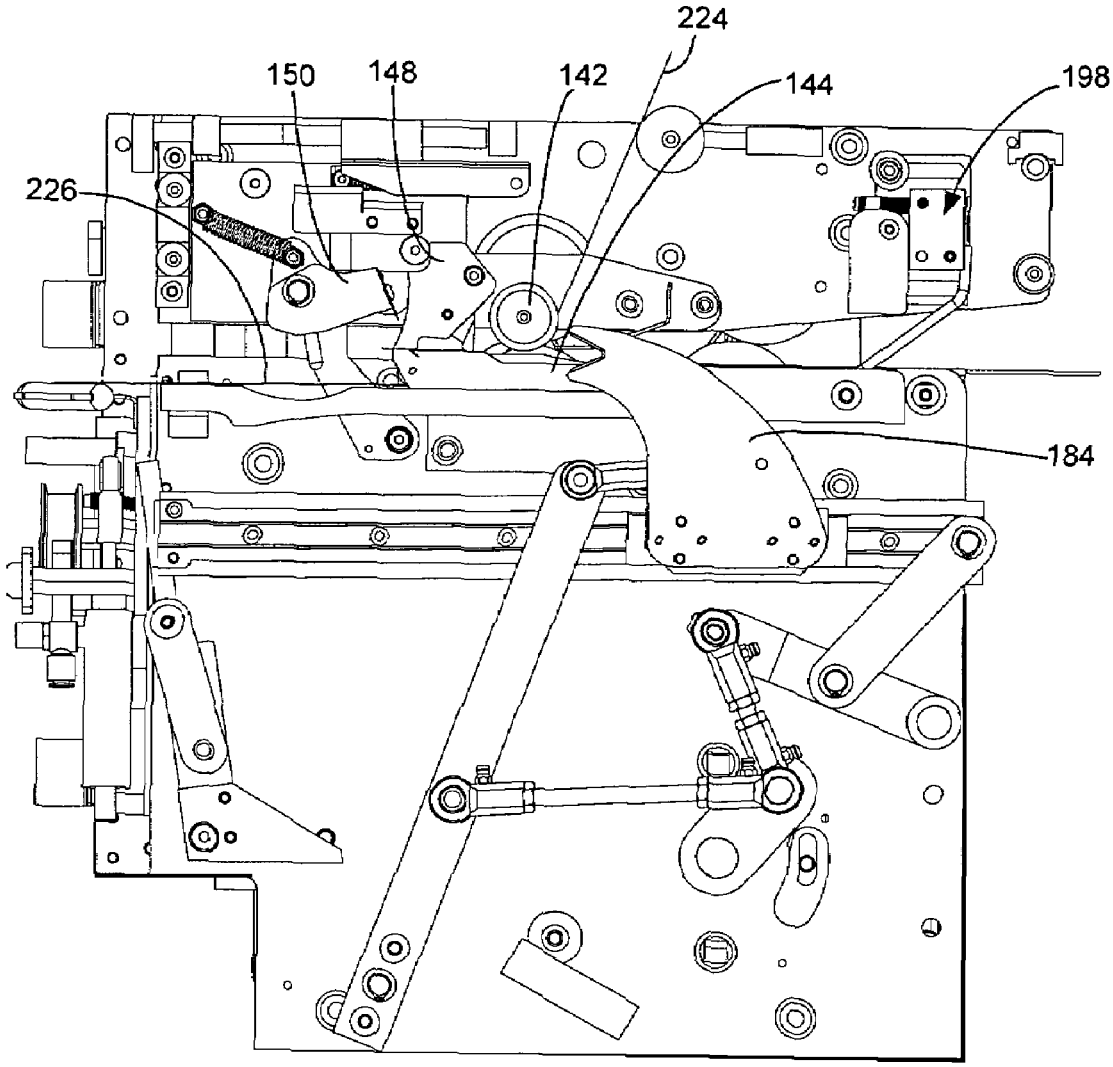
FIG. 10 is a front view of a portion of the tape closure device in a second stage of operation.
Figure 11:
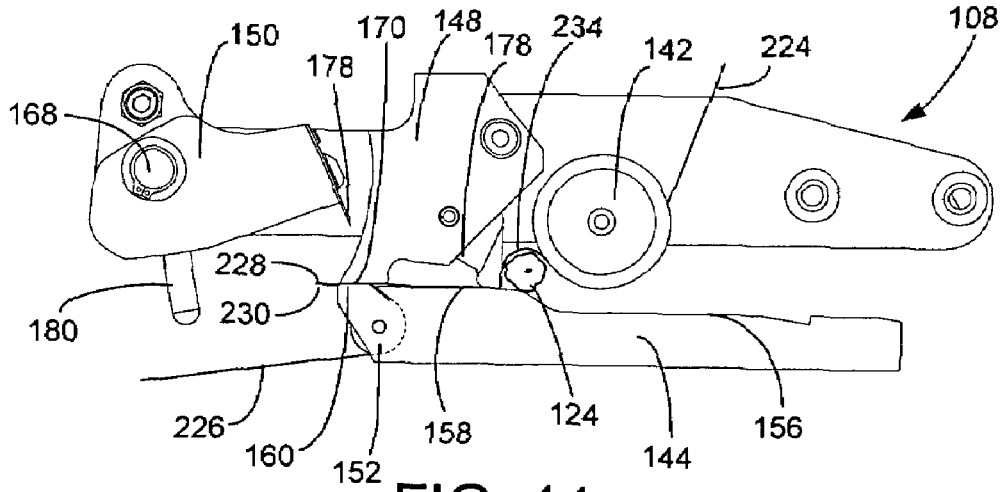
FIG. 11 is a close-up illustration of the closure application assembly at the second stage of operation shown in FIG. 10.

FIGS. 10 and 11 present snapshot representations of the closure application assembly 108 in a second stage of operation as the bag neck 124 is pushed by drive rollers 196 into the gathering section 158 of the guide rail 144. The stepped profile of the guide rail 144 and the bag stop 172 cooperatively cause the neck 124 to be gathered tightly. As best shown in FIG. 11, the bag neck 124 is pressed under the adhesive side of the tape 224, forming the beginning of a loop 234. At this point in the process, the bag neck 124 has pressed the spring-biased bag stop 172 into recess 176. It should be noted that the tape 224 is still secured to a portion of the gathering section 158 of the guide rail 144. Once the neck 124 has been sufficiently gathered and compressed against the bag stop 172, the plunger assembly 102 forces the neck 124 through the balance of the closure application assembly 108.

Figure 12:
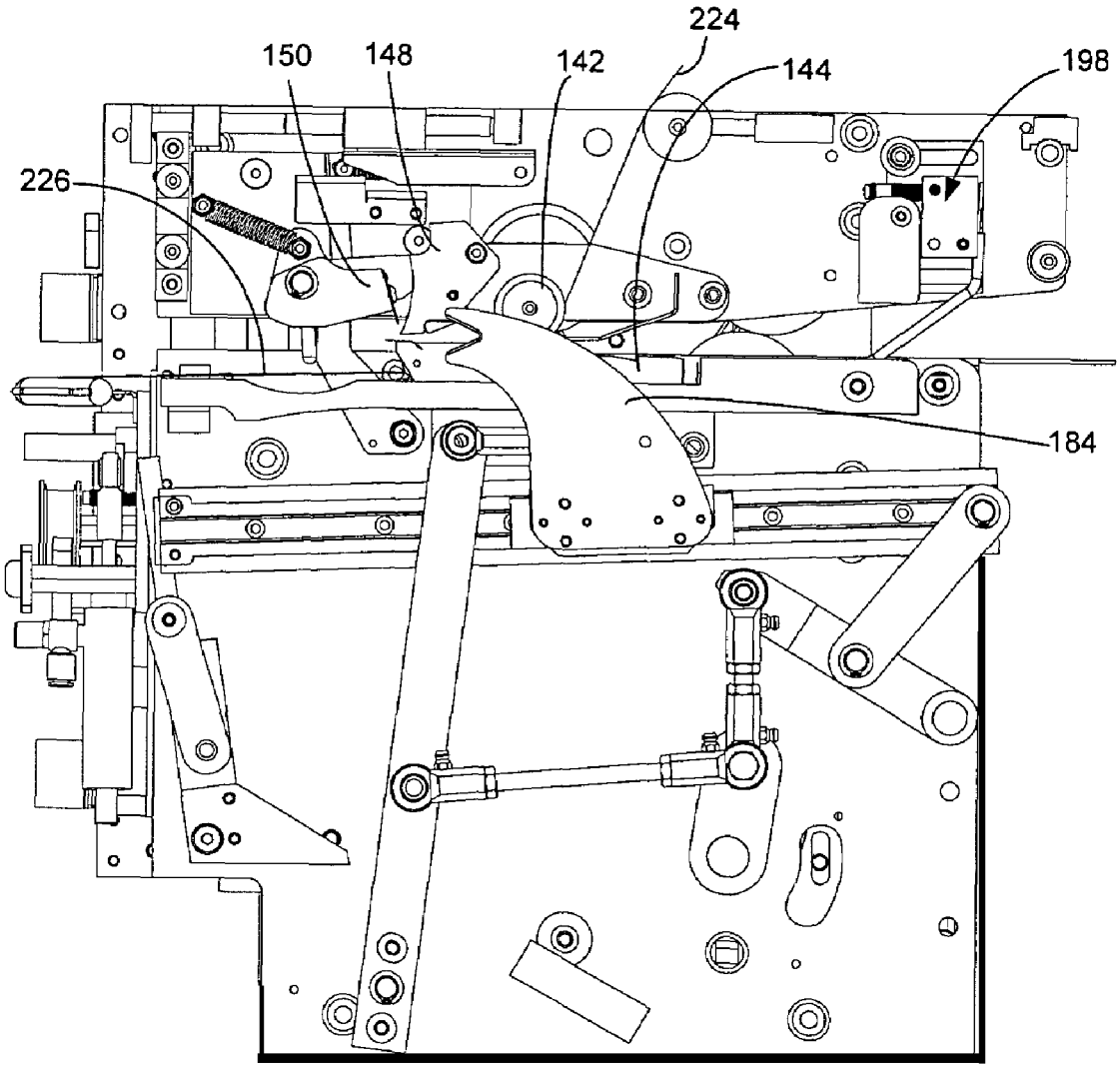
FIG. 12 is a front view of a portion of the tape closure device in a third stage of operation.
Figure 13:
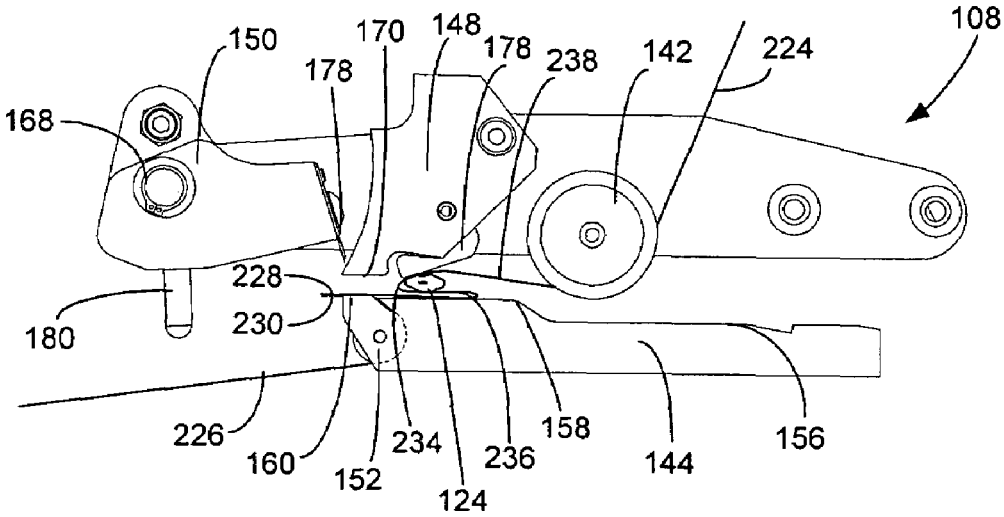
FIG. 13 is a close-up illustration of the closure application assembly at the third stage of operation shown in FIG. 12.

FIGS. 12 and 13 illustrate a snapshot of the closure application assembly 108 in a third stage of operation as the bag neck 124 is captured by the plungers 184 and pushed under the contact member 148, thereby forcing the spring-biased contact member 148 upward away from the contact section 160. As shown in FIG. 13, the downstream movement of the bag neck 124 against the tape 224 causes the portion of the tape 224 secured to the gathering section 158 to loop back over itself. As the tape 224 peels from the gathering section 158, an exposed portion 236 of the adhesive side of the tape 224 is revealed.

Figure 14:
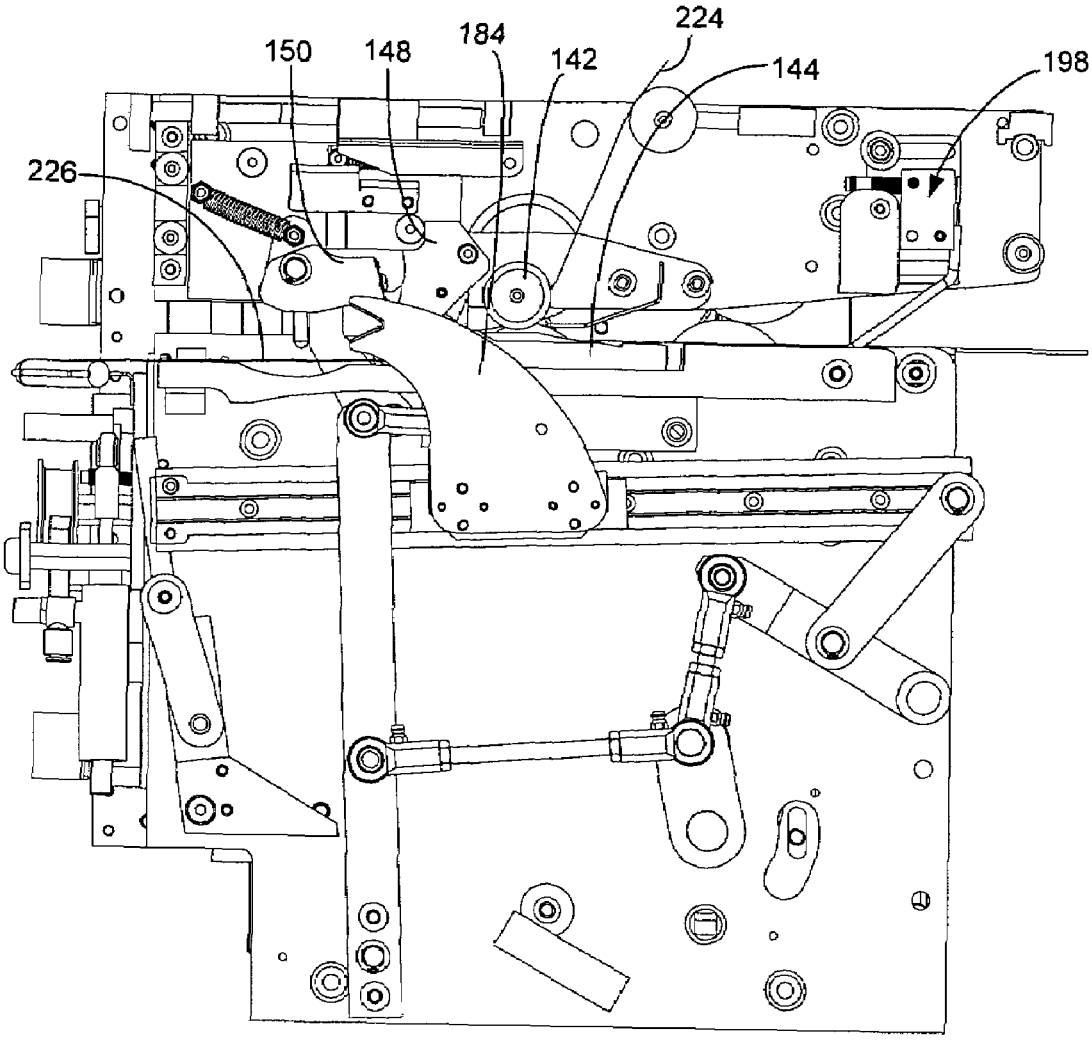
FIG. 14 is a front view of a portion of the tape closure device in a fourth stage of operation.
Figure 15:
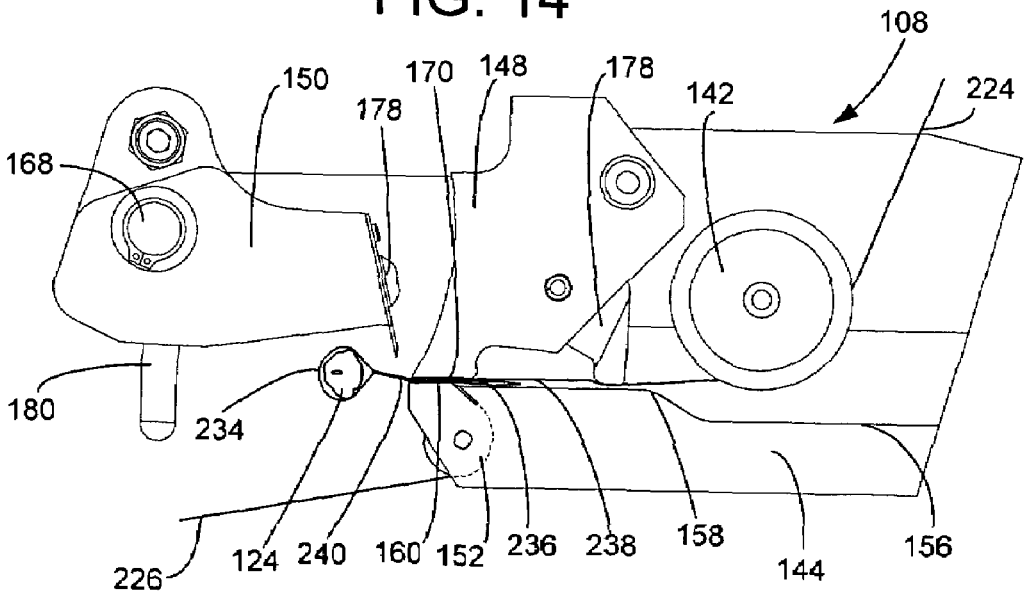
FIG. 15 is a close-up illustration of the closure application assembly at the fourth stage of operation shown in FIG. 14.

In FIGS. 14 and 15, the plungers 184 have moved the bag neck 124 out from under the contact member 148. The spring-loaded contact member 148 closes down on a trailing portion 238 of the tape 224. The contact surface 170 presses the downward facing adhesive side of the trailing portion 238 against the upward facing adhesive side of the exposed portion 236, thereby completing the loop 234 and forming a closure stem 240. The plungers 184 continue to carry the bag neck 124 away from the contact member 148, and in doing so, unpeel the remaining portion of the tape 224 secured to the gathering section 158. When all of the tape 224 secured to the gathering section 158 has been unpeeled and combined with the trailing portion 238 to complete the closure stem 240, the first leg 232 is pulled from the contact section 160. The adhesive side of the trailing portion 238 of the tape 224 then contacts the exposed paper 226 to form a second leg 242.

Figure 16:
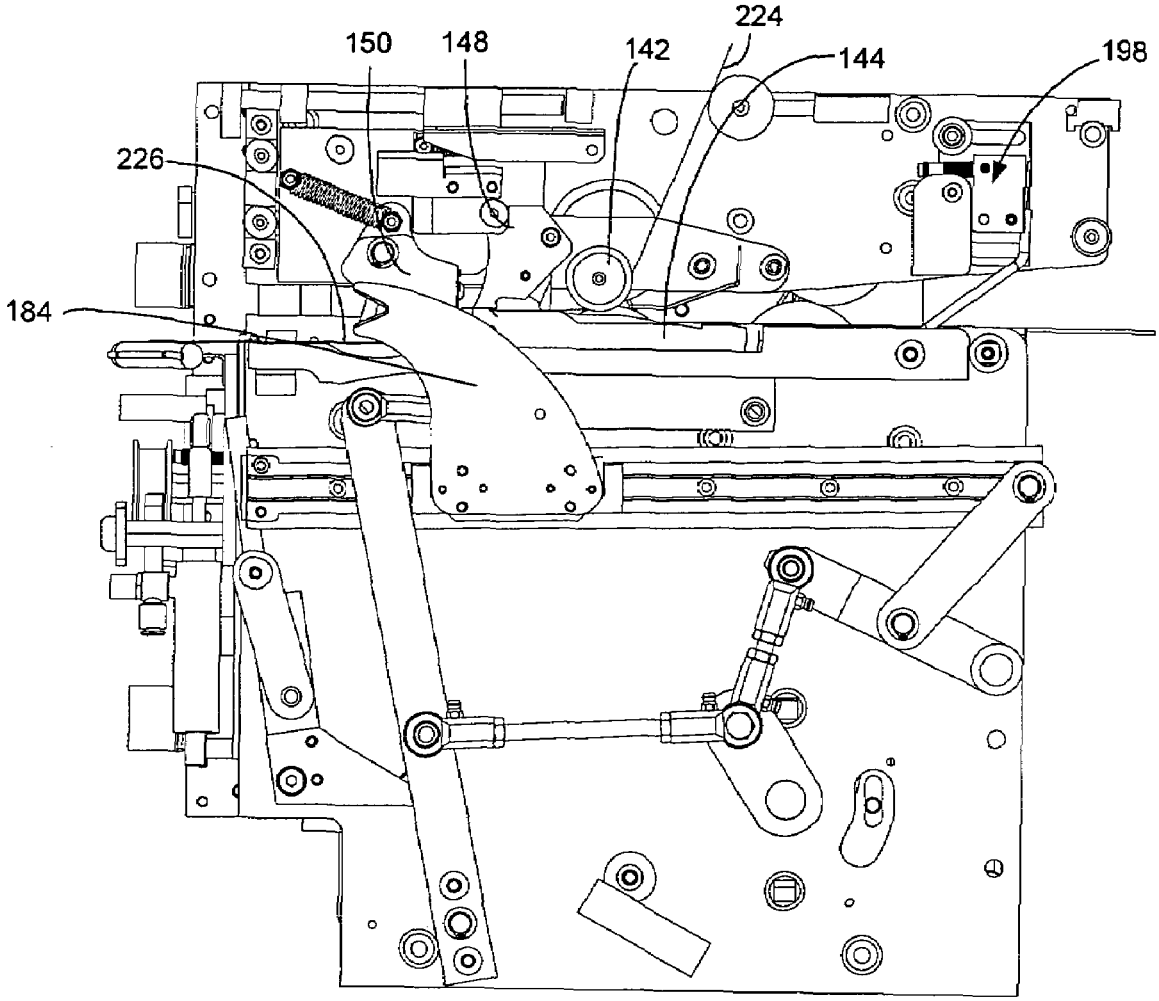
FIG. 16 is a front view of a portion of the tape closure device in a fifth stage of operation.
Figure 17:
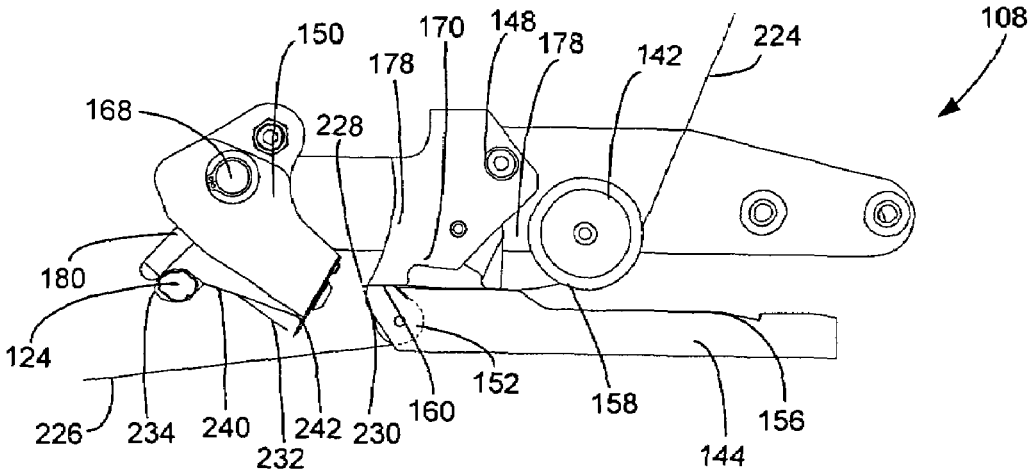
FIG. 17 is a close-up illustration of the closure application assembly at the fifth stage of operation shown in FIG. 16.
Figure 18:
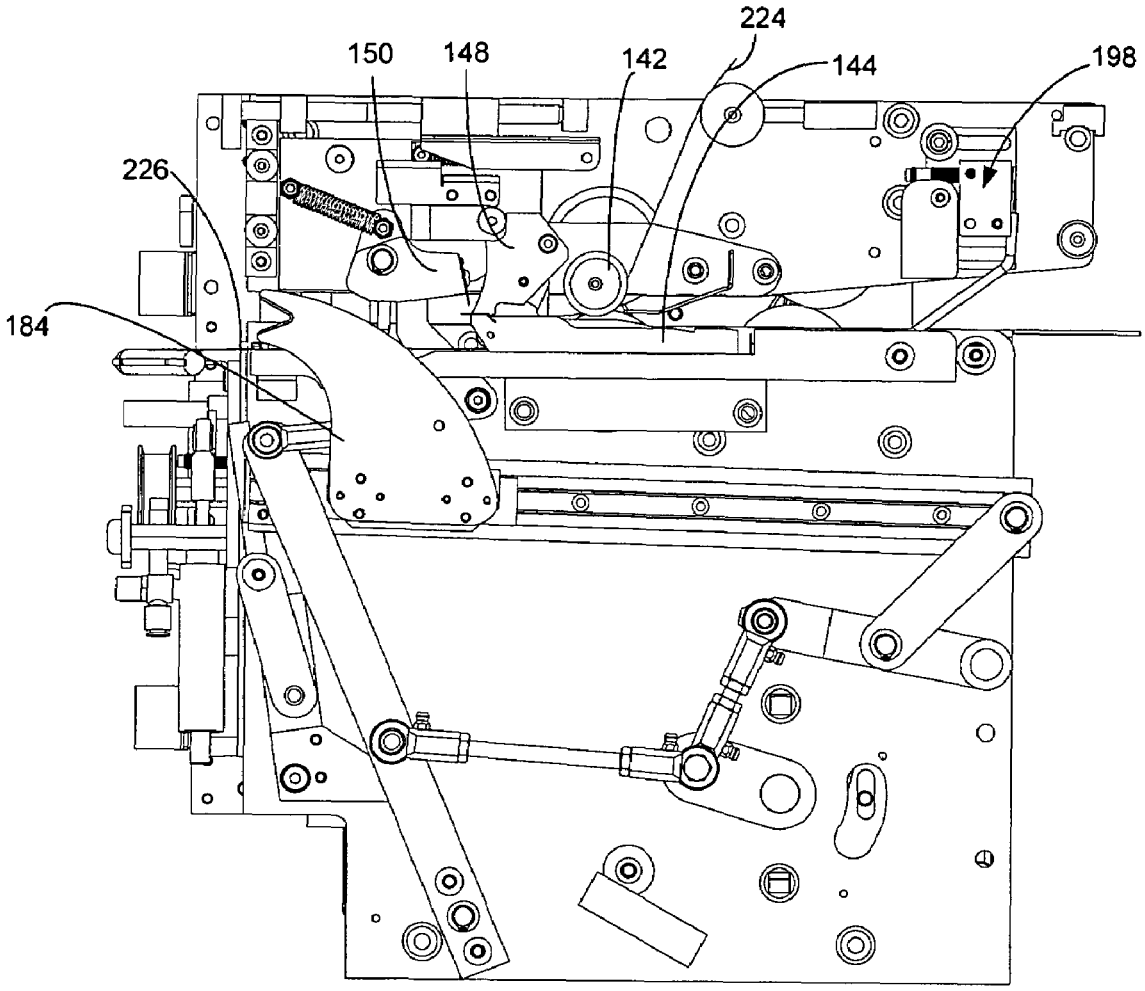
FIG. 18 is a front view of a portion of the tape closure device in a sixth stage of operation.
Figure 19:
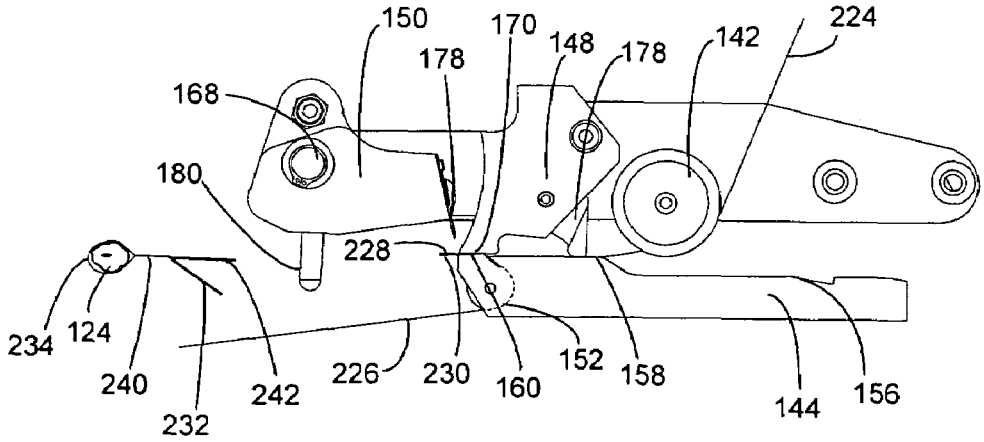
FIG. 19 is a close-up illustration of the closure application assembly at the sixth stage of operation shown in FIG. 18.

Turning to FIGS. 16 and 17, the plungers 184 continue to move the enclosed neck 124 downstream and into contact with the pivot arm 180 of the cutting member 150. As the bag neck 124 presses against the pivot arm 180, the cutting member rotates clockwise about pivot 168 forcing blade 178 through the second leg 242. The closure cycle is completed as the plungers 184 push the tape closure 126 beyond the cutting member 150, as shown in FIGS. 18 and 19. Once the taped bag neck 124 clears the pivot arm 180 of the cutting member 150, the spring 182 returns the cutting member 150 to its initial position. The plunger assembly 102 then completes its cycle by circling below the guide rail 144 to the starting position shown in FIG. 8. During the closure cycle, the track 186 and linkages 188 cause the plungers 184 to move below the path of the bag 120 as the plungers 184 return to the starting position.

As shown in FIG. 21, the resulting tape closure 126 includes a loop 234, a stem 240, a first leg 232 and a second leg 242. The lengths of the stem 240 and the first and second legs 232, 242 are dependent on the thickness of the bag neck 124, the distance between the contact section 160 and the pivot arm 166 and the length of the gathering section 158. Changes to the dimensions of the tape closure 126 can be easily made by selecting cutting members 150 and contact members 148 with different geometries.

The paper 226 connected along the inside of the first and second legs 232, 234 facilitates the opening of the closure 126 by preventing the first and second legs 232, 234 from sealing against one another. In a preferred embodiment, the tape 224 is a PVC film coated on one side with a rubber-based adhesive. Suitable tape is available from Decker Tape Products, Inc., of Fairfield, N.J. The paper 226 can be any paper that is capable of adhering to the adhesive side of the tape 224 and which can be easily torn to open the closure 126.

The closure application assembly 108 provides a non-stop, linear mechanism that provides a tight tape closure 126 as bags 120 pass through the tape closure device 100. The linear, constant movement of the bag 120 through the closure application assembly 108 enables the tape closure device 100 to be used for high-speed, high-volume operation. Furthermore, because the amount of tape and backing paper applied for each closure is variable and dependent upon the size of the neck 124 of the bag 20, the length of the first and second legs 232, 242 formed by the closure 126 can be easily controlled. Controlling the dimensions of the tape closure 126 facilitates the application of printed information on the closure 126.

In another aspect, preferred embodiments provide a method for applying a tape closure 126 around a bag neck 124. The method includes the steps of using the bag feed assembly 110 to deliver the open end 122 of the bag 120 into the closure application assembly 108, using the bag feed assembly 110 to gather the neck 124 of the bag 120 under the tape 224, using the plunger assembly 102 to push the neck 124 of the bag 120 into the bag stop 172 and contact member 142 to begin the formation of a loop 234, using the plunger assembly 102 to push the neck 124 under the contact member 142 to further define the loop 234 around the bag neck 124, using the plunger assembly 102 to push the bag neck 124 beyond the contact member 142 to allow the contact member 142 to fall against the contact section 160 of the guide rail 144 to close the loop 234 and using the plunger assembly 102 to push the bag neck 124 into the cutting member 150 to cause the cutting member 150 to rotate and sever the trailing portion of the tape 224 to complete the formation of the bag closure 226.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms expressed herein and within the appended claims. It will be appreciated by those skilled in the art that the teachings of the present invention can be applied to other systems without departing from the scope and spirit of the present invention.

It is claimed:

1. A tape closure device comprising:

a plunger assembly, wherein the plunger assembly comprises:

a pair of plungers;

a track; and a plurality of linkages that cause the plungers to move in an elliptical pattern during the course of a closure cycle;

a tape feed assembly;

a paper feed assembly;

a closure application assembly, wherein the closure application assembly includes a movable contact member having a retractable bag stop;

a cutting member; and a bag feed assembly.

2. A tape closure device for securing the neck of a bag with an adhesive film and a non-adhesive backing, the device comprising:

a closure application assembly, wherein the closure application assembly comprises:

a guide rail having a contact section, a gathering section and a staging section;

a contact member having a contact surface adjacent the contact section; and a cutting member;

a tape feed assembly, wherein the tape feed assembly includes a tape guide pulley above the staging section of the guide rail and wherein the tape guide pulley is configured to feed tape onto at least a portion of the contact section;

a paper feed assembly, wherein the paper feed assembly includes a paper feed pulley below the contact section of the guide rail and wherein the paper feed pulley is configured to feed paper onto at least a portion of the contact section; and a bag feed assembly, wherein the bag feed assembly comprises:

a plurality of brushes configured to rotate on horizontal axes;

a plurality of auxiliary brushes;

an upper drive roller; and a lower drive roller.

3. The tape closure device of claim 2, wherein the closure application assembly further includes a blade guard.

4. The tape closure device of claim 2, wherein contact member further includes a pivot arm.

5. The tape closure device of claim 2, wherein the cutting member further includes a lever arm and a blade.

6. The tape closure device of claim 2, wherein the upper drive roller is free to translate in a vertical direction and the lower drive roller is fixed in its vertical position.

7. The tape closure device of claim 2, wherein the bag feed assembly further comprises a sensor having a trigger and a counterweight.

8. A tape closure device for securing the neck of a bag with an adhesive film and a non-adhesive backing, the device comprising:

a closure application assembly, wherein the closure application assembly comprises:

a guide rail having a contact section, a gathering section and a staging section;

a contact member having a contact surface adjacent the contact section; and a cutting member;

a tape feed assembly, wherein the tape feed assembly includes a tape guide pulley above the staging section of the guide rail and wherein the tape guide pulley is configured to feed tape onto at least a portion of the contact section;

a paper feed assembly, wherein the paper feed assembly includes a paper feed pulley below the contact section of the guide rail and wherein the paper feed pulley is configured to feed paper onto at least a portion of the contact section; and a bag feed assembly, wherein the bag feed assembly comprises:

an upper gathering belt;

a lower gathering belt; and wherein the upper gathering belt is driven by its contact with the lower gathering belt.

9. A tape closure device comprising:

a plunger assembly;

a tape feed assembly;

a paper feed assembly;

a closure application assembly, wherein the closure application assembly includes a movable contact member having a retractable bag stop;

a cutting member; and a bag feed assembly, wherein the bag feed assembly comprises:

a pair of counter-rotating brushes that rotate on substantially horizontal axes that are substantially parallel to the path of the bag through the tape closure device; and a pair of counter-rotating auxiliary brushes that rotate on substantially horizontal axes that are substantially transverse to the path of the bag through the tape closure device.

10. The tape closure device of claim 9, wherein the bag feed assembly further comprises a pair of counter-rotating drive rollers downstream from the auxiliary brushes.

* * * * *